US005377702A

United States Patent [19]

Sakurai

[11] Patent Number: 5,377,702

[45] Date of Patent: Jan. 3, 1995

[54] BEAUTY UNIT

[75] Inventor: Yoshihiro Sakurai, Tokyo, Japan

[73] Assignees: Kabushiki Kaisha Japan Fitness; Kabushiki Kaisha Lucent, both of Tokyo, Japan

[21] Appl. No.: 131,806

[22] Filed: Oct. 5, 1993

[30] Foreign Application Priority Data

Apr. 15, 1993 [JP] Japan ..... 5-111199

[51] Int. Cl.[6] ..... A45D 20/08

[52] U.S. Cl. ..... 132/271; 601/78; 601/80

[58] Field of Search ..... 132/286, 271, 272, 333; 128/38, 39, 40, 56

[56] References Cited

U.S. PATENT DOCUMENTS

| | | | |
|---|---|---|---|
| 1,882,040 | 10/1932 | Roehm | 128/39 |
| 2,249,500 | 7/1941 | Shirley et al. | 128/38 |
| 3,818,904 | 6/1974 | Kawada | 128/40 |
| 3,906,940 | 9/1975 | Kawada | 128/40 |
| 5,003,966 | 4/1991 | Saka et al. | 128/39 |

FOREIGN PATENT DOCUMENTS

| | | | |
|---|---|---|---|
| 1060405 | 4/1954 | France | 132/271 |
| 0008746 | 2/1990 | Japan | 132/333 |
| 0102290 | 11/1916 | United Kingdom | 132/333 |

*Primary Examiner*—Gene Mancene
*Assistant Examiner*—Frank A. LaViola
*Attorney, Agent, or Firm*—Jordan and Hamburg

[57] ABSTRACT

The present invention relates to a beauty unit for applying an absorbing action and a pressing action to the skin. The beauty unit comprises an electromagnet excited by a commercial power supply, an air pump having an absorbing opening portion for guiding negative pressure air and a discharge opening portion for guiding a pressing opening portion, operating members associated with the exciting action of the electromagnet to apply amplitude motion to diaphragms of the air pump, a control circuit for controlling the exciting action of the electromagnet, a main body having an inserting opening portion connected to the absorbing opening portion and the discharge opening portion, respectively, and a manipulating member comprised of a flexible introducing tube provided at one end with a rear connector capable of being inserted into the inserting opening portion and at the other end with a skin contact appliance.

17 Claims, 7 Drawing Sheets

BEAUTY UNIT

BACKGROUND OF THE INVENTION

1. Field of the Invention

The present invention relates to a beauty unit for applying an absorbing action and a pressing action to the skin.

2. Description of the Prior Art

There is known a conventional beauty unit in which an absorbing action and a pressing action are applied to the skin so as to raise stains, makeup dregs or the like adhered to a sweat gland and a sebaceous gland to the skin surface or a massage is given to the skin so as to facilitate the circulation of the blood. Such a beauty unit as described has a body capable of being carried by hand. The body is interiorly provided with a motor, a motion conversion mechanism for converting rotation of the motor into reciprocating motion, and an operating body in which a diaphragm is operated by the motion conversion mechanism to alternately form a negative pressure state and a pressing state. A skin contact portion is provided on the outside of the body. This skin contact portion is brought into pressure contact with the skin surface to thereby apply the absorbing action and the pressing action to the skin surface.

In the conventional beauty unit as described above, its relatively heavy body which encases therein the motor and the motion conversion mechanism is carried by hand for use. Accordingly, not only there occurs an inconvenience of giving the hand fatigue but also the maniputability is poor since the body is large. There are other disadvantages that a motor having a large capacity cannot be used, and since the unit has a rotating part, the using life thereof is short.

SUMMARY OF THE INVENTION

An object of the present invention is to improve the above-described disadvantages of the prior art and to provide a beauty unit whose portion carried by hand is light in weight and manipulatability is excellent.

A beauty unit according to the present invention comprises an electromagnet excited by a commercial power supply, an air pump having an absorbing opening portion for guiding negative pressure air and a discharge opening portion for guiding a pressing opening portion wherein a negative pressure state and a pressing state are alternately formed in an internal chamber by amplitude motion of diaphragms, operating members associated with the exciting action of the electromagnet to apply the amplitude motion to the diaphragms of the air pump, a control circuit for controlling the exciting action of the electromagnet, a body having inserting opening portions connected to the absorbing opening portion and the discharge opening portion, respectively, and a manipulating member comprising a flexible tube having a rear end connector capable of being inserted into the inserting opening portion provided at one end and a skin contact appliance provided at the other end.

The air pump is formed at both left and right sides with diaphragms for receiving external vibrations from the center portion to provide amplitude, and further formed at both left and right sides with operating members, which are in turn connected to the center portions of the diaphragms.

The control circuit comprises a frequency switching circuit having a terminal for continuously outputting commercial frequencies to the electromagnet and a terminal for intermittently outputting commercial frequencies, an output switching circuit for switching the magnitude of output of a commercial power supply, a light emitting element to be lighted when a power supply is inputted, and a light emitting element to be lighted when the output of the frequency switching circuit is turned ON.

Further, the body comprises a square bottom plate and a cover for covering the upper portion of the bottom plate. The electromagnet, and the air pump, the operating members, the control circuit are arranged on the bottom plate. These parts are covered with the cover, and the inserting opening portion is exposed to a part of the cover. A switching rotatable knob for the frequency switching circuit and a switching pressing portion for the output switching circuit in the control circuit are projected through a hole provided in the cover. The light emitting elements are provided opposite to a transparent plate provided on the body. In the manipulating member, as one means, a front connector is provided at the front end of the introducing tube, and the connector is removably closely fitted in a hollow shaft portion of the skin contact appliance provided integral with the bowl-like contact portion at the extreme end of the hollow shaft portion. As the other means, a front connector is provided at the front end of the introducing pipe, and the connector is removably closely fitted in the hollow shaft portion of the skin contact appliance comprising an instrument having a diaphragm which provides amplitude by vibration of air and a pressing element which is vibrated by the amplitude of the diaphragm at the extreme end of the hollow shaft portion. The front connector has in its outer periphery a recessed groove extending from an intermediate position to the foremost edge in the lengthwise direction thereof, and the skin contact appliance has in its inner periphery of the shaft portion a recessed groove extending from an intermediate position to the end edge in the lengthwise direction.

With the structure as described above, when a commercial power supply is applied by a power supply cord, the control circuit is operated so that N-pole and S-pole of the electromagnet are alternately magnetized. The diaphragms provide the amplitude by the operating members which are vibrated in response to the exciting action, and thus the negative pressure state and the pressing state are alternately formed in the internal chamber of the air pump. The negative pressure air generated by the negative pressure state is introduced into the absorption opening portion, and the pressing air generated by the pressing state is introduced into the discharge opening portion.

When the frequency switching circuit is switched, the electromagnet is continuously or intermittently excited, and when the output switching circuit is switched, the magnitude of the magnetizing force is adjusted. The exciting state of the electromagnet is displayed by the light emitting element.

Accordingly, in the operating state of the electromagnet the rear end connector of the operating appliance is connected to the inserting opening portion in communication with the absorption opening portion or the discharge opening portion, and the skin contact appliance is pressed against the skin. Then, when the rear end connector is connected to the absorption opening portion, it is possible to apply the absorption action to the skin. When the rear end connector is connected to the discharge opening portion, it is possible to apply the pressing action to the skin. Further, when a skin contact appliance provided with a pressing element is used, it is possibly to give the skin a massage.

As described above, according to the present invention, since the part to be carried by hand is light in weight, the unit can be used without occurrence of fatigue, and the manipulatability of the unit is excellent. Further it is possible to further add a large capacity electromagnet, an air pump and accessorial parts to the main body portion. Moreover, since the electromaget can be excited continuously or intermittently or the magnitude of the exciting action can be controlled, the unit can be applied to many modes of use. Furthermore, there is a further advantage that the intermittent pressing action and absorbing action can be positively carried out.

DESCRIPTION OF THE PREFERRED EMBODIMENTS

Figure 1:
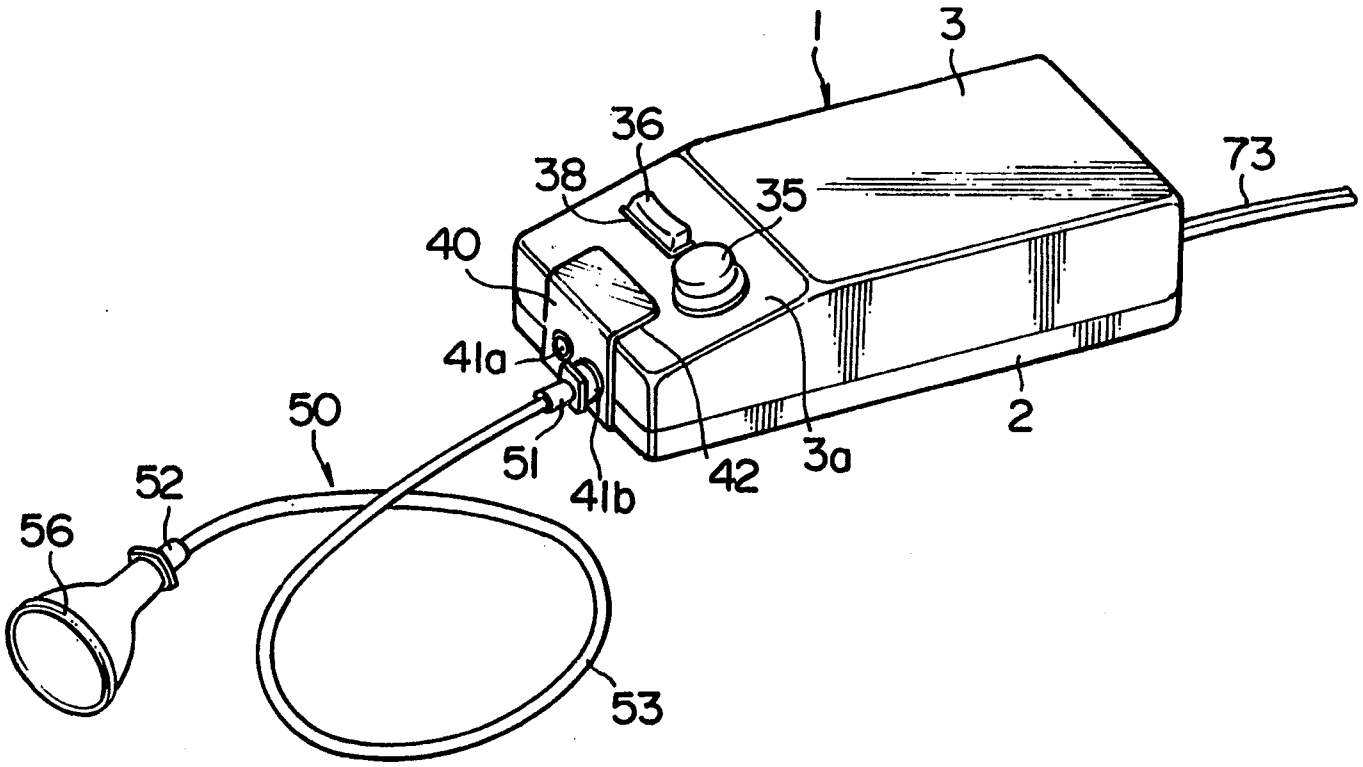
FIG. 1 is an overall perspective view of the beauty unit according to the present invention.
Figure 2:
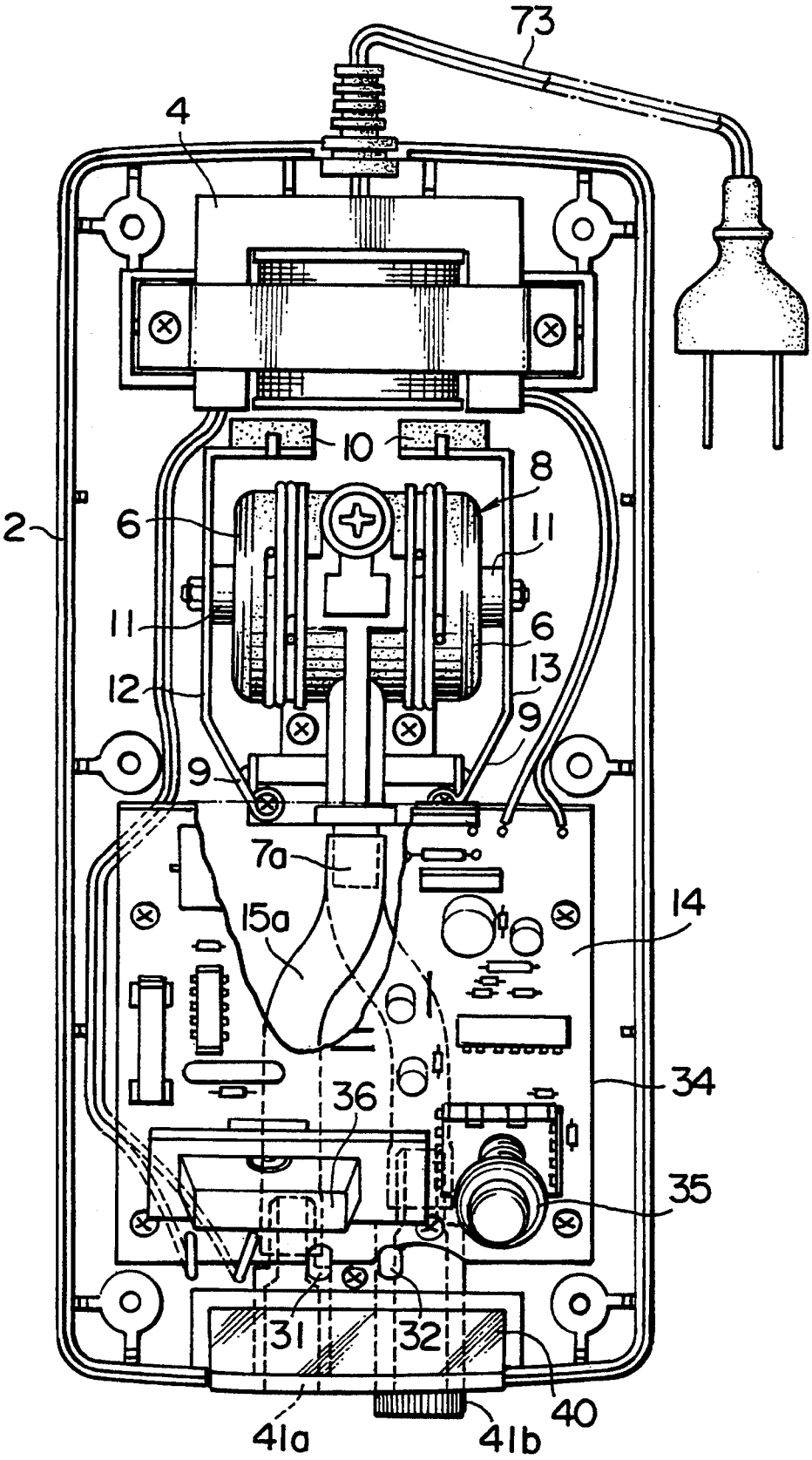
FIG. 2 is a partly cutaway plan view showing the interior of the body of the beauty unit according to the present invention.
Figure 3:
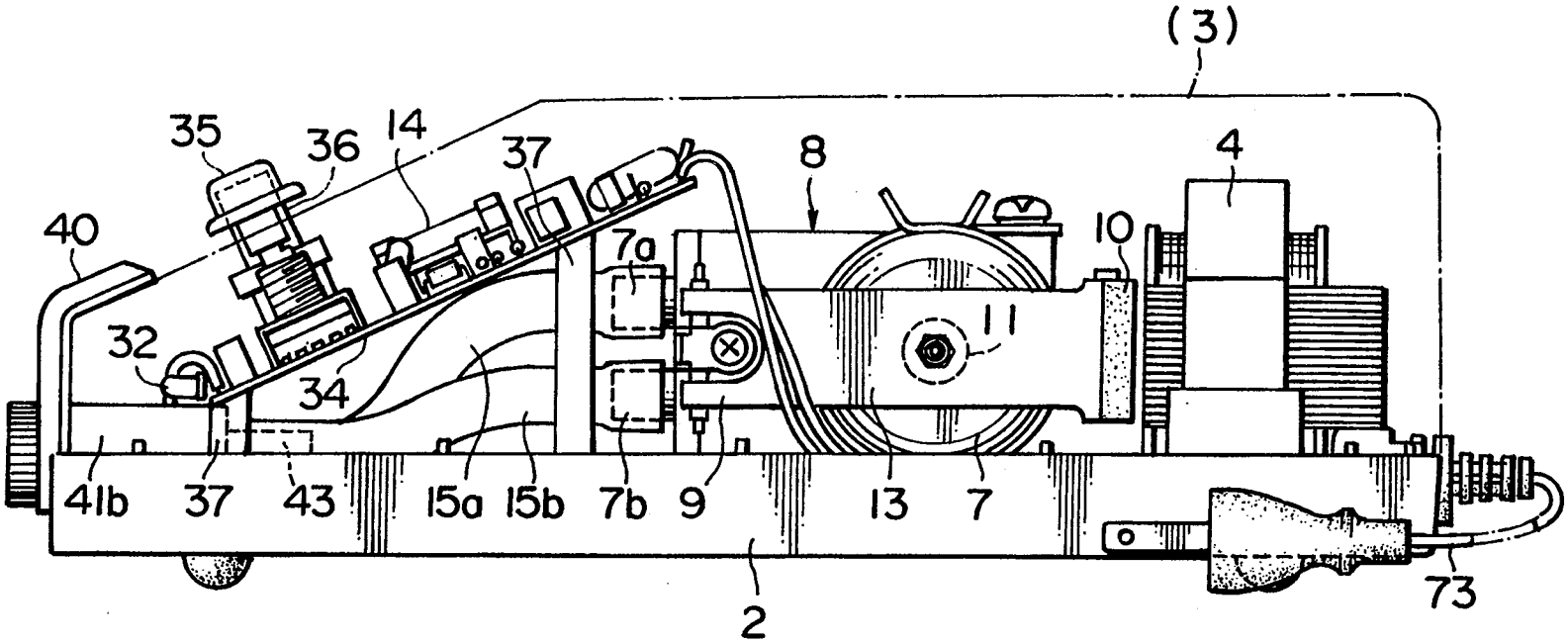
FIG. 3 is a side view showing the interior of the body of the beauty unit according to the present invention.

Embodiments of the beauty unit according to the present invention will be described hereinbelow with reference to the drawings. As shown in FIGS. 1 to 3, the main body 1 comprises a shallow square bottom plate 2 having a rising rib along the peripheral edge and a deep box-like cover 3 whose lower surface is open and front portion is inclined frontwardly. The bottom plate 2 and the cover 3 are fastened by screws in the state where they are vertically joined together.

The bottom plate 2 is provided with an electromagnet 4, and a closed tubular air pump 8 whose both sides are closed by diaphragms 6 and 6 and which alternately forms a negative pressure state and a pressing state in an internal chamber by applying amplitude motion to center portions of the diaphragms 6 and 6. There is further provided an absorption opening portion 7*a* for introducing a negative pressure air and a discharge opening portion 7*b* for introducing a pressing air, and a pair of operating members 12 and 13 having a base end 9 fixedly mounted on the air pump 8 opposite to left and right positons of the air pump 8 and having a magnet 10 opposite to the magnetizing surface of the electromagnet 4 at the free end thereof. A control circuit 14 controls the excitation of the electromagnet 4, and connecting tubes 15*a* and 15*b* are connected to the absorption opening portion 7*a* and the discharge opening portion 7*b*, respectively.

Figure 4:
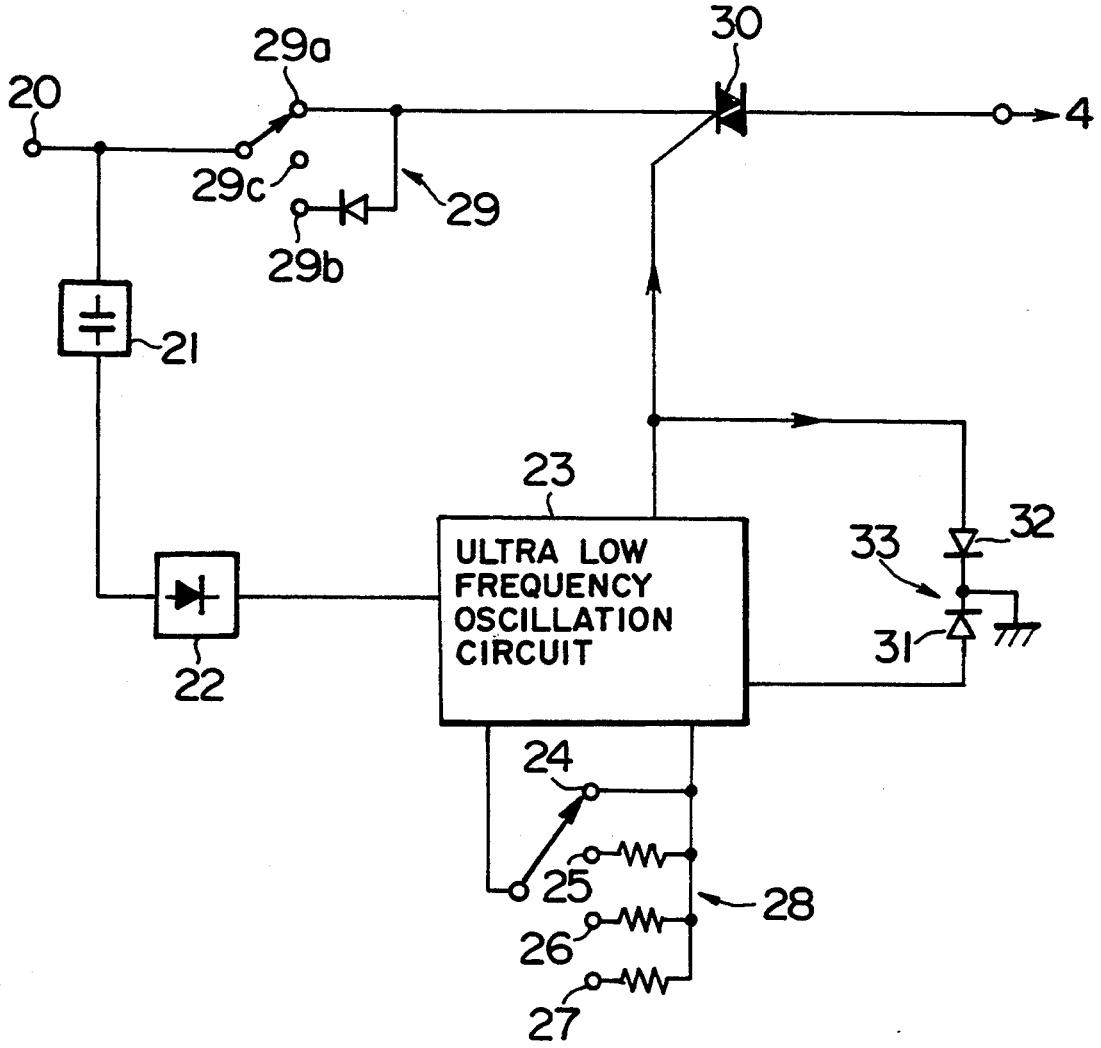
FIG. 4 is a view showing a control circuit of the beauty unit according to the present invention.

Boss portions 11 provided in the center portions of the diaphragms 6 and 6 forming the side of the air pump 8 are connected in the intermediate position to the pair of left and right operating members 12 and 13, respectively. In the control circuit 14, as shown in FIG. 4, an ultralow frequency oscillation circuit 23 comprised an IC is connected to an input terminal 20 of a commercial power supply through a series circuit of a voltage dropping capacitor 21 and a rectification circuit 22. Connected to the ultralow frequency oscillation circuit 23 is a frequency switching circuit 28 having a terminal 24 for continuously outputting the frequency and terminals 25, 26 and 27 for intermittently outputting the frequency at intervals of 0.08 second, 0.28 seconds and 1.2 seconds.

Further, connected to the input terminal 20 is a TRIAC SSR (a Solid State Relay) 30 through an output switching circuit 29 for switching a commercial power supply and an output for subjecting a commercial power supply to half-wave rectification to reduce the effective value in half. The gate of the TRIAC SSR 30 is connected to the output end of the ultralow frequency oscillation circuit 23. A display circuit 33 comprising a light emitting element 31 of green, for example, which is lighted when a power supply is inputted and a light emitting element 32 of red, for example, which is lighted when the gate output is ON is connected to the frequency switching circuit 28.

Thus configured control circuit 14 is disposed on a printed board 34 and is provided with a rotatable knob 35 for switching the frequency switching circuit 28 and a push botton 36 which is tiltable in a see-saw manner for switching the output switching circuit 29. The printed board 34 is mounted in a frontwrdly inclined state by four corner portions thereof securely attached to four supports 37 stood upright on the bottom plate 2. The rotatable knob 35 and the push button 36 are projected so that they can be operated externally through a through-hole 38 provided in the inclined front surface portion 3*a* of the cover 3 when the cover 3 is securely attached to the bottom plate 2.

On the front central portion of the bottom plate 2 is stood upright a transparent plate 40, at the lower portion of which inserting opening portions 41*a* and 41*b* connected to the connecting tubes 15*a* and 15*b*, respectively, are arranged in parallel, the upper portion thereof being inwardly curved. This transparent plate 40 is fitted in a cut recess portion 42 provided in the front central portion of the cover 3 when the latter is mounted on the bottom plate 2. The light emitting elements 31 and 32 are positioned opposite to of the curved portion of the transparent plate 40. A filter 43 is interposed interiorly of the inserting opening portions 41*a* and 41*b*.

Figure 5:
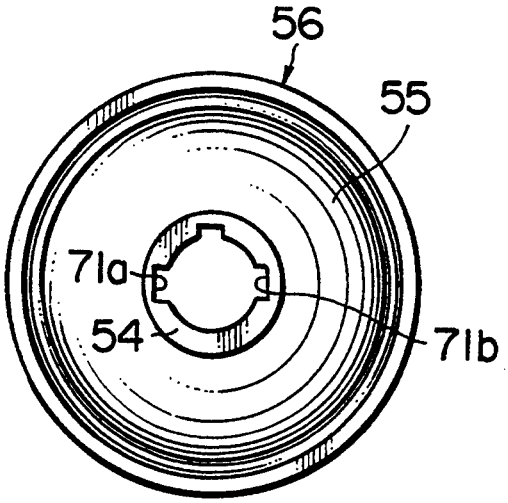
FIG. 5 is a back view of a skin contact appliance of the beauty unit according to the present invention.
Figure 6:
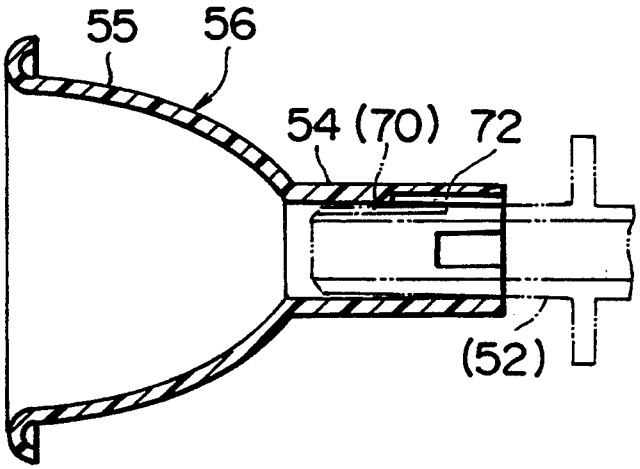
FIG. 6 is a longitudinal sectional side view of the skin contact appliance according to the present invention.
Figure 7:
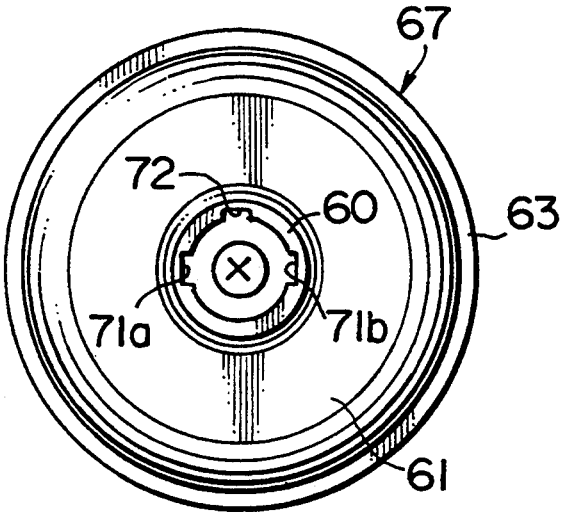
FIG. 7 is a back view of a further skin contact appliance of the beauty unit according to the present invention.
Figure 8:
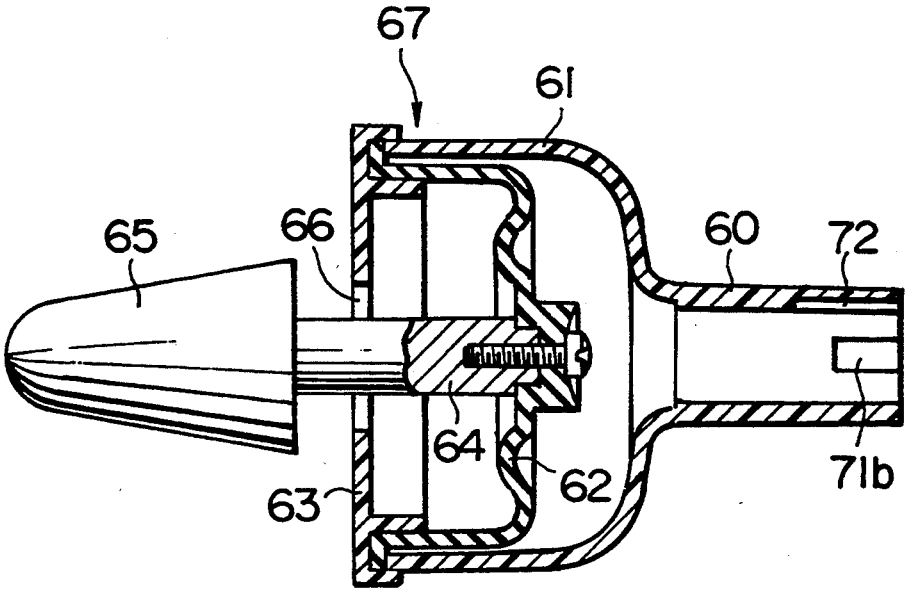
FIG. 8 is a longitudinal sectional side view of another skin contact appliance of the beauty unit according to the present invention.

On the other hand, an operating appliance 50 for applying an absorbing action and a pressing action to the skin comprises a lengthy flexible introducing tube 53 formed of synthetic resin provided at the rear end with a front connector 51 with a flange which can be selectively inserted into the inserting opening portions 41*a* and 41*b* and at the front end with a front connector 52 with a flange which can be inserted into skin contact appliances 56 and 67 which will be described later. Skin contact appliance 56 formed of synthetic resin in the form of a funnel as a whole in which a contact portion 55 is integrally provided at the extreme end of a hollow shaft portion 54 having the front connector 52 closely fitted therein as shown in FIGS. 5 and 6. Skin contact appliance 67 comprises a hemispherical cap 61 integrally provided at the extreme end of a hollow shaft portion 60 having the front connector 52 closely fitted therein and a lid plate 63 for closing the open surface of the cap 61 and having a diaphragm 62 fixedly fitted therein as shown in FIGS. 7 and 8. The skin contact appliance 67 has a warhead-like pressing portion 65 projected from a fitting hole 66 bored in the center portion of the lid plate 63 through a shaft 64 provided in the center portion of the diaphragm 62 so that the diaphragm 62 is subjected to amplitude by the entry of pressurized air to provide the pressing portion 65 amplitude.

Figure 9:
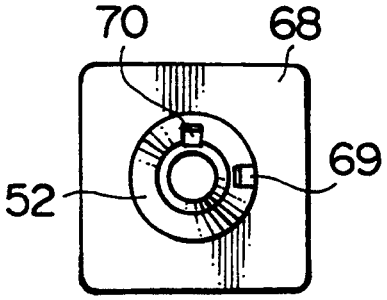
FIG. 9 is an end view of a front connector of the beauty unit according to the present invention.
Figure 10:
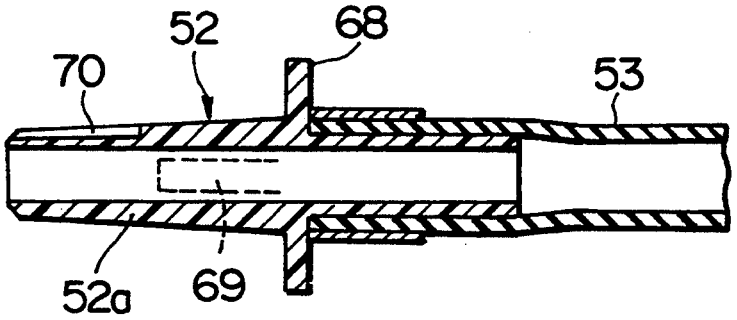
FIG. 10 is a longitudinal sectional side view of a front connector of the beauty unit according to the present invention.

As shown in FIGS. 9 and 10, the front connector 52 comprises a tubular body having a flange 68 in the middle thereof. An axially extending engaging protrusion 69 is provided close to the flange 68 of an outer half portion 52*a* of the front connector 52, and a recessed groove 70 extending from an axial intermediate position to an outer end edge is provided at a position displaced by 90° therefrom. Two engaging grooves 71*a* and 71*b* selectively engaged with the engaging protrusion 69 are provided in the inner peripheral surfaces of the shaft portions 54 and 60 into which the front connector 52 is closely fitted diametrically opposite to a position of the opening portion thereof, and a recessed groove 72 is provided positioned in the middle therebetween, said recessed groove 72 extending from the lengthwise intermediate position to the end edge so that when the engaging protrusion 69 is engaged with one engaging groove 71*a*, the recessed groove 72 comes into communication with the recessed groove 70.

Now, when a commercial power supply is applied through a power supply cord 73 and one end of the push button 36 is depressed to switch the OFF terminal 29*c* of the output switching circuit 29 to the strong-side terminal 29*a*, for example, a commercial power supply of 50/60 HZ is applied to the TRIAC SSR 30 so that the light emitting element 31 on the edge side of the display circuit 33 is lighted to display the state of energization.

Subsequently, when the rotatable knob 35 is operated to be rotated to select, for example, the terminal 24 for continuation of the frequency switching circuit 28, the ON signal is continuously outputted from the ultralow frequency oscillation circuit 23. Accordingly, the electromagnet 4 is alternately excited to N-pole and S-pole at a period of 50/60 HZ to repeat the absorption action and repulsion action between the electromagnet 4 and the magnets 10 whereby the operating members 12 and 13 are vibrated. With this vibration, the center portions of the diaphragms 6 and 6 which constitute the sides of the air pump 8 provide amplitude in the direction of the front face. Thereby, the internal chamber of the air pump 8 repeatedly assumes the negative pressure state and the pressing state, and when the internal chamber assumes the negative pressure state, the negative pressure air is guided into the absorption opening portion 7*a*. When the internal chamber assumes the pressing state, the pressurized air is guided into the discharge opening portion 7*b*, and the gate signal of the TRIAC SSR 30 is turned ON so that the red light emitting diode 32 is lighted to display the operating state.

When the output switching circuit 29 is switched to the weak-side terminal 29*b*, the output is reduced in half. Therefore, the exciting action of the electromagnet 4 also becomes weakened, and the amplitude of the operating members 12 and 13 becomes small so that the negative pressure and pressing air to be obtained also become weakened.

When the terminal 25 for intermittence of the frequency switching circuit 28 is selected by rotating the rotatable knob 35, for example, when the terminal 26 for intermittence is selected at a period of 0.08 second, and for example, when the terminal 27 for intermittence is further selected at a period of 0.28 second, the exciting action of the magnet 4 is controlled at a period of 1.2 seconds, for example.

Accordingly, the strong (high) and weak (low) states of air pressure can be selected by depressing the push button 36, and the continuous operation and intermittent operation can be selected by rotating the rotatable knob 35.

Accordingly, when the skin contact appliance 56 is used for the beauty operation, the front connector 52 of the introducing tube 53 is connected to the shaft portion 54 and the rear connector 51 is connected to one of the inserting opening portions 41*a* and 41*b* provided on the main body 1. The contact portion 55 is then brought into pressure contact with the skin surface.

When the rear connector 51 of the introducing tube 53 is connected to the inserting opening portion 41*b* on the discharge side, the pressing action can be applied continuously or intermittently to the skin surface. When the rear connector 51 is connected to the inserting opening portion 41*a* on the suction side, the absorbing action can be applied continuously or intermittently to the skin surface to thereby enable raising of stains, makeup dregs or the like adhered to a sweat gland and a sebaceous gland to the skin surface and giving a stimulus to the skin so as to facilitate the circulation of the blood.

Further, when the other skin contact appliance 67 is used, the front connector 52 of the introducing tube 53 is connected to the shaft portion 60 and the rear connector 51 thereof is connected to the inserting opening portion 41*a* or 41*b* provided on the main body 1. Next, the pressing portion 65 is urged against the skin surface. Furthermore, the rotatable knob 35 is rotated to select the terminals 25 to 27 for intermittence.

Then, the diaphragm 62 is subjected to amplitude intermittently by the vibration of air, and therefore, the pressing portion 6 is also intermittently vibrated to enable giving a massage to the skin.

Further, when the engaging protrusion 69 is engaged with one engaging groove 71*b* of the shaft portions 54 and 60 when the front connector 52 of the introducing tube 53 is connected to the shaft portion 54 or 64, the recessed grooves 70 and 72 are closed to each other by the inner peripheral surface of the other so that the suction force and the pressing force within the contact portion 55 or the vibration pressure of the pressing portion can be increased. As shown by the imaginary line in FIG. 6, when the engaging protrusion 69 is engaged with the other engaging groove 71*a*, the recessed grooves 70 and 72 become communicated. Therefore, when the interior of the skin contact appliances 56 and 67 is changed from the pressing state to the stopping state, the pressure in the skin contact appliances 56 and 67 temporarily restores to the atmospheric pressure. Accordingly, this action is repeatedly carried out so that the intermittent pressing action and absorbing action are positively carried out.

I claim:

1. A beauty unit comprising:

an electromagnet excited by a commercial power supply, an air pump having diaphragms, an absorbing opening portion for guiding negative pressure and a discharge opening portion for guiding a pressing opening portion, wherein a negative pressure state and a pressing state are alternately formed in an internal chamber by vibration of said diaphragms, operating members associated with the exciting action of the electromagnet to apply amplitude motion to the diaphragms of the air pump, a control circuit for controlling the exciting action of the electromagnet, a main body having inserting opening portions connected to the absorbing opening portion and the discharge opening portion, respectively, and a manipulating member comprising a flexible introducing tube having a rear end connector capable of being inserted into the inserting opening portion provided at one end and a skin contact appliance provided at an opposite other end thereof.

2. The beauty unit according to claim 1, wherein:

said air pump is formed in left and right sides thereof by said diaphragms which have center portions that receive external vibrations to provide said amplitude motion, and the operating members are opposedly provided on the left and right sides of said air pump, and are connected to the center portions of said diaphragms.

3. The beauty unit according to claim 1, wherein said control circuit comprises a frequency switching circuit having a terminal for continuously outputting commercial frequencies to the electromagnet and a terminal for intermittently outputting commercial frequencies to the electromagnet.

4. The beauty unit according to claim 1, wherein said control circuit comprises an output switching circuit for switching the output of the commercial power supply to strong (high) and weak (low) levels.

5. The beauty unit according to claim 1, wherein said control circuit comprises a display circuit comprising a light emitting element which is lighted when a power supply is inputted.

6. The beauty unit according to claim 1, wherein a front connector is provided at a front end of said introducing tube, said front connector being removably closely fitted into a hollow shaft of the skin contact appliance, and said skin contact appliance being provided with a bowl-shaped contact portion at an extreme end of the hollow shaft and being formed integral therewith.

7. The beauty unit according to claim 6, wherein a recessed groove extending from an intermediate position to an extreme end edge in a lengthwise direction is provided in an outer periphery of the front connector, and a recessed groove extending from an intermediate position to an end edge in the lengthwise direction is provided in an inner periphery of the shaft of the skin contact appliance.

8. The beauty unit according to claim 1, wherein a front connector is provided at the front end of said introducing tube, said front connector being removably closely fitted into a hollow shaft portion of said skin contact appliance, said skin contact appliance being provided with an instrument having a diaphragm subjected to amplitude motion by air vibration and a pressing portion which is vibrated by the amplitude motion of said diaphragm at an extreme end of the hollow shaft portion.

9. The beauty unit according to claim 8, wherein a recessed groove extending from the intermediate position to an extreme end edge in a lengthwise direction is provided in an outer periphery of the front connector, and a recessed groove extending from an intermediate position to an end edge in the lengthwise direction is provided in an inner periphery of the shaft portion of the skin contact appliance.

10. The beauty unit according to claim 1, wherein said control circuit comprises:

a frequency switching circuit having a terminal for continuously outputting commercial frequencies to the electromagnet and a terminal for intermittently outputting commercial frequencies to the electromagnet, and an output switching circuit for switching the output of the commercial power supply to strong (high) and weak (low) levels.

11. The beauty unit according to claim 10, wherein:

said main body comprises a square bottom plate having an upper portion, and a cover for covering the upper portion thereof, said bottom plate having said electromagnet, said air pump, said operating members and said control circuit arranged thereon, and said electromagnet, said air pump, said operating members and said control circuit are covered with the cover, said inserting opening portion is exposed to a part of said cover, a switching rotatable knob of said frequency switching circuit and a switching pressing portion of said output switching circuit in said control circuit are protruded through a hole provided in said cover, and a light emitting element is opposed to a transparent plate provided on the main body.

12. A beauty unit comprising:

an electromagnet excited by a commercial power supply, an air pump formed in left and right sides thereof by diaphragms which have center portions that receive external vibrations to provide an amplitude motion, an absorbing opening portion for guiding negative pressure and a discharge opening portion for guiding a pressing opening portion, wherein a negative pressure state and a pressing state are alternately formed in an internal chamber by vibration of said diaphragms, operating members associated with the exciting action of the electromagnet to apply said amplitude motion to the diaphragms of the air pump, the operating members being opposedly provided on the left and right sides of said air pump, and being connected to the center portions of said diaphragms, a control circuit for controlling the exciting action of the electromagnet, said control circuit including:

a frequency switching circuit having a terminal for continuously outputting commercial frequencies to the electromagnet and a terminal for intermittently outputting commercial frequencies to the electromagnet, and an output switching circuit for switching the output of the commercial power supply to strong (high) and weak (low) levels, a main body having inserting opening portions connected to the absorbing opening portion and the discharge opening portion, respectively, and a manipulating member comprising a flexible introducing tube having a rear end connector capable of being inserted into the inserting opening portion provided at one end and a skin contact appliance provided at an opposite other end thereof.

13. The beauty unit according to claim 12, wherein:

said main body comprises a square bottom plate having an upper portion, and a cover for covering the upper portion thereof, said bottom plate having said electromagnet, said air pump, said operating members and said control circuit arranged thereon, and said electromagnet, said air pump, said operating members and said control circuit are covered with the cover, said inserting opening portion is exposed to a part of said cover, a switching rotatable knob of said frequency switching circuit and a switching pressing portion of said output switching circuit in said control circuit are protruded through a hole provided in said cover, and a light emitting element is opposed to a transparent plate provided on the main body.

14. The beauty unit according to claim 12, wherein a front connector is provided at a front end of said introducing tube, said front connector being removably closely fitted into a hollow shaft of the skin contact appliance, and said skin contact appliance being provided with a bowl-shaped contact portion at an extreme end of the hollow shaft and being formed integral therewith.

15. The beauty unit according to claim 14, wherein a recessed groove extending from an intermediate position to an extreme end edge in a lengthwise direction is provided in an outer periphery of the front connector, and a recessed groove extending from an intermediate position to an end edge in the lengthwise direction is provided in an inner periphery of the shaft of the skin contact appliance.

16. The beauty unit according to claim 12, wherein a front connector is provided at the front end of said introducing tube, said front connector being removably closely fitted into a hollow shaft portion of said skin contact appliance, said skin contact appliance being provided with an instrument having a diaphragm subjected to amplitude motion by air vibration and a pressing portion which is vibrated by the amplitude motion of said diaphragm at an extreme end of the hollow shaft portion.

17. The beauty unit according to claim 16, wherein a recessed groove extending from the intermediate position to an extreme end edge in a lengthwise direction is provided in an outer periphery of the front connector, and a recessed groove extending from an intermediate position to an end edge in the lengthwise direction is provided in an inner periphery of the shaft portion of the skin contact appliance.

* * * * *